United States Patent [19]

Schnittjer et al.

[11] 4,163,627

[45] Aug. 7, 1979

[54] MOUNTING FOR AN IMPLEMENT ON A TRACTOR

[75] Inventors: Bradley J. Schnittjer, Delhi; Michael J. O'Neill, Davenport, both of Iowa

[73] Assignee: Deere & Company, Moline, Ill.

[21] Appl. No.: 825,624

[22] Filed: Aug. 18, 1977

[51] Int. Cl.[2] ..... E02F 3/72

[52] U.S. Cl. ..... 414/686; 172/274; 414/786

[58] Field of Search ..... 214/131 A, 138 R, 152; 172/272, 273, 274, 275; 280/760

[56] References Cited

U.S. PATENT DOCUMENTS

| | | | |
|---|---|---|---|
| 2,777,376 | 1/1957 | Schwegler | 172/275 X |
| 2,815,876 | 12/1957 | Rogers | 214/131 A |
| 2,931,525 | 4/1960 | Davis | 280/760 X |
| 2,972,424 | 2/1961 | Cadwell | 172/272 X |
| 3,054,520 | 9/1962 | Maloney | 214/131 A X |
| 3,460,690 | 8/1969 | Seifert | 214/131 A X |
| 3,795,332 | 3/1974 | Eriksson | 214/131 A X |
| 3,982,643 | 9/1976 | MacGregor et al. | 214/131 A |
| 4,065,009 | 12/1977 | Old | 214/131 A |

*Primary Examiner*—L. J. Paperner

[57] ABSTRACT

A tractor has a main frame with a fore and aft body portion and a transverse rear axle housing, and includes a pair of hydraulic outlets. A transverse upright U-shaped member depends from the body portion of the tractor and has a central fore and aft socket, and a pair of rearwardly open V-shaped latch elements are connected to the tractor axle housing. A separate backhoe has a forwardly extending frame portion having a probe at its forward end that is insertible into the socket and has a pair of transverse pins extending outwardly from opposite sides of the frame for engagement with the V-shaped latch elements. The backhoe is mounted on the tractor by backing the tractor toward the backhoe with the tractor wheels straddling the fore and aft backhoe frame portion. Backhoe control valves are then connected to the tractor hydraulic outlets, so that the backhoe frame can be adjusted to a height and attitude wherein the probe is aligned with the socket on the tractor and the pins are aligned with the latch element on the axle housing. The tractor is then backed until the probe enters the socket and the pins engage the latch elements, and the pins are then locked into the latches.

12 Claims, 7 Drawing Figures

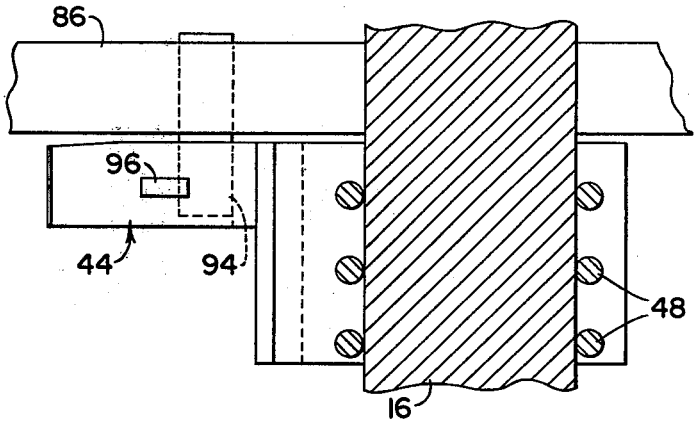
FIG. 3
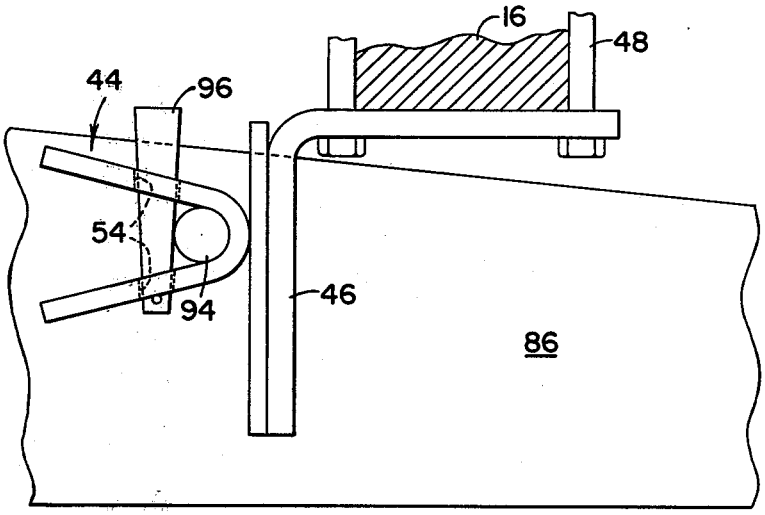
FIG. 2
FIG. 4
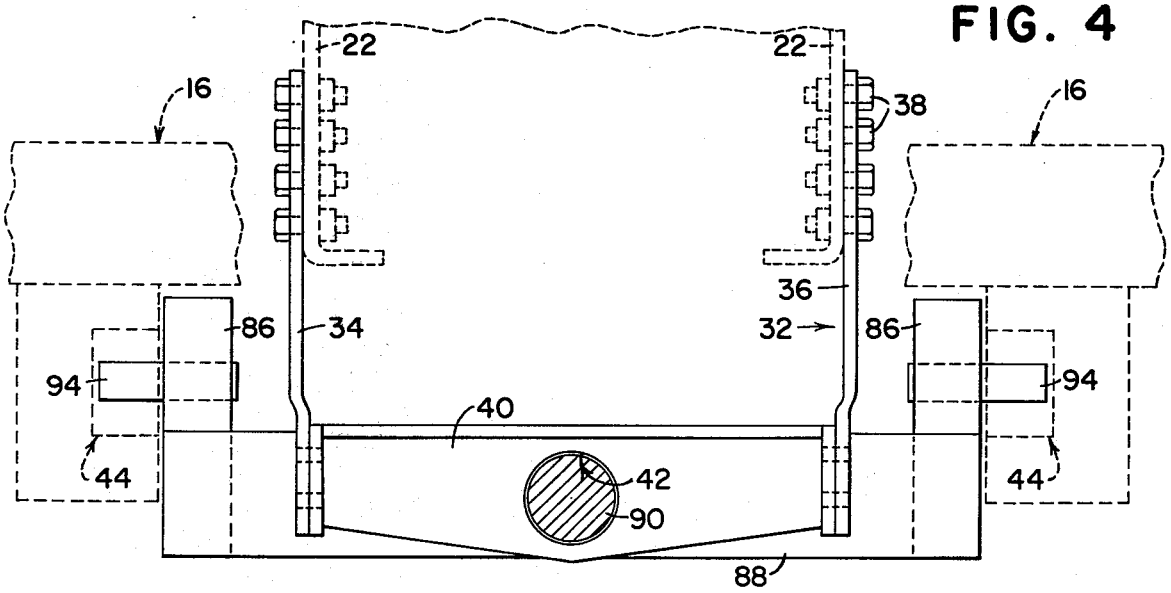

MOUNTING FOR AN IMPLEMENT ON A TRACTOR

BACKGROUND OF THE INVENTION

This invention relates to an improved method and apparatus for mounting a material handling machine such as a backhoe on a tractor.

Tractor-mounted backhoes have become widely used machines used for a wide variety of applications. Originally such machines were mounted on agricultural tractors or slightly modified versions thereof, the backhoe being removable from the tractor to free the tractor for other uses. However, over the years, the size, capacity, and durability of tractor-mounted backhoe that are conventionally used in utility and industrial work have increased to the point that the backhoes have been more or less permanently mounted on industrial type tractors. Such heavy-duty backhoes and tractors are relatively expensive, however, and there has developed a market for smaller, lighter duty backhoes that can be quickly mounted on or removed from an agricultural tractor, such backhoes having particular appeal for farmers, who would already have an agricultural tractor and have need for a tractor-mounted backhoe on relatively infrequent occasions, such as laying tile or digging drainage ditches.

For such light duty, occasionally used backhoes, it is necessary that they be easily connected to or disconnected from the tractor, and it is known to mount such backhoes on the three-point hitches of a conventional agricultural tractor using the conventional hydraulic outlets on the tractor to supply the necessary hydraulic power for operation of the backhoe. Such a three-point hitch mounted backhoe is described in U.S Pat. No. 3,904,051, also assigned to the assignee herein. A somewhat similar three-point hitch mounted backhoe is described in U.S. Pat. No. 3,966,065. However, as described in said patent, the three-point hitch mounted backhoes have a stability problem and require certain devices to overcome potential safety hazards.

SUMMARY OF THE INVENTION

According to the present invention, there is provided an improved method and apparatus for mounting an implement such as a light duty backhoe on a conventional agricultural tractor. More specifically, the implement is mounted directly on the tractor frame, eliminating any potential safety hazards associated with a three-point hitch mounting of an implement, such as a backhoe.

An important feature of the invention resides in the quick and easy mounting of the implement on the tractor, without the necessity for strenuous labor or special tools. Still more specifically, a backhoe mounting is provided wherein the operator merely has to back the tractor up to the disconnected backhoe, hook up the hoses from the backhoe to the tractor hydraulic outlets, and then using the backhoe hydraulic controls raise the backhoe frame to the proper attitude and height wherein the mounting elements on the tractor are aligned with the mounting elements on the backhoe, whereupon the tractor is simply backed further until the mounting elements are engaged, at which time a simple locking device is used to lock the backhoe frame to the tractor frame.

Another important feature resides in the fact that the mounting reduces the forces transmitted from the implement to the tractor frame.

BRIEF DESCRIPTION OF THE DRAWINGS

FIG. 2 is an enlarged side elevation view of a portion of the backhoe frame showing its connection to the tractor axle housing.

FIG. 3 is a plan view of the element shown in FIG. 2.

FIG. 4 is a front elevation view of the implement mounting as viewed along the lines 4—4 of FIG. 1, with certain background portions of the tractor shown in dotted lines.

DESCRIPTION OF THE PREFERRED EMBODIMENT

Figure 1:
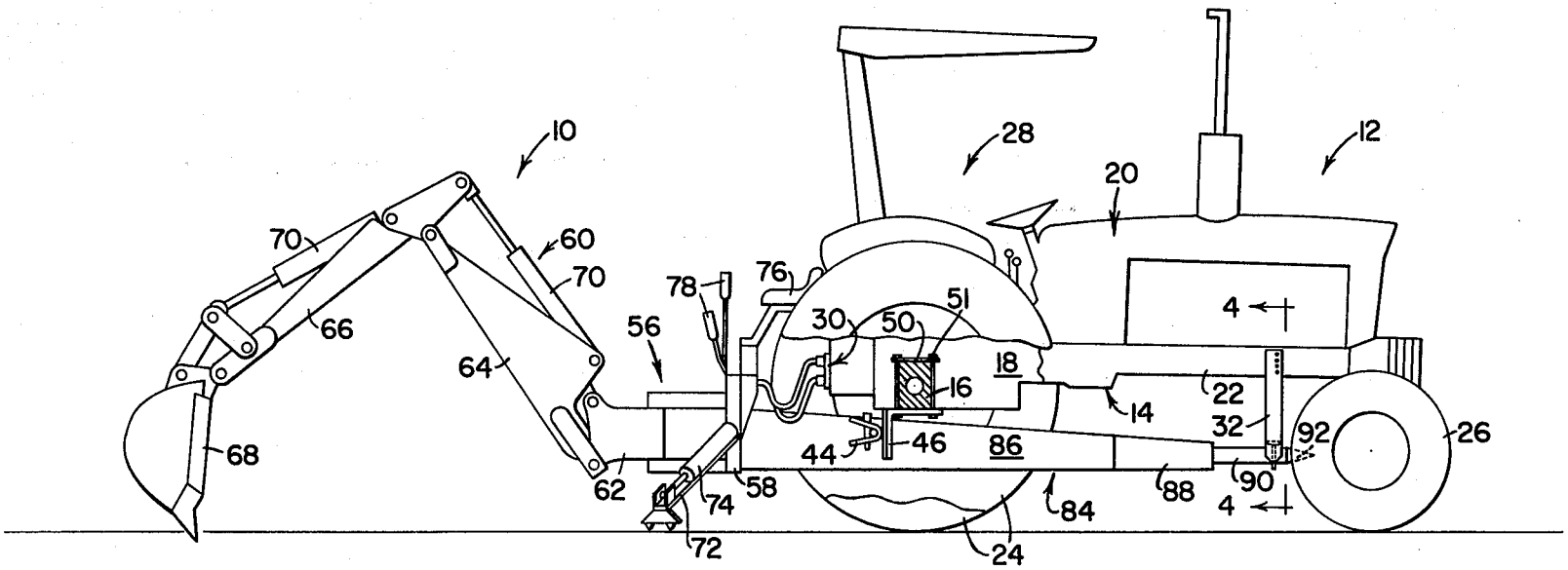
FIG. 1 is a somewhat schematic side elevation view of a tractor backhoe combination with the backhoe attached to the tractor frame, portions of the tractor being broken away to more clearly show the invention.

The invention is embodied in the mounting of a backhoe, indicated generally by the numeral 10, on an agricultural type tractor, indicated generally by the numeral 12. The tractor has a main frame indicated in its entirety by the numeral 14, the frame including a transverse axle housing 16 at the rear of the tractor, a transmission housing 18 extending forwardly from the central portion of the axle housing, and a forward fore and aft or body portion 20, the body portion including a pair of channel type side members 22 extending in a fore and aft direction along opposite sides of the body portion 20. The tractor has a pair of laterally spaced rear wheels 24 at the opposite ends of the axle housing 16 and a pair of steerable fron wheels 26, and an operator's station 28 is disposed above the axle housing 16. All of the above is more or less conventional tractor construction, and as is also conventional, the tractor includes an internal combustion engine (not shown), which drives a hydraulic pump having an associated reservoir (also not shown). The pump and reservoir are respectively connectible to a pair of hydraulic outlets 30 at the rear of the tractor adjacent the operator's station. It is conventional to provide at least one pair of such outlets on agricultural tractor for supplying hydraulic power to trailing implements, the outlets being respectively connected to the pump and the reservior through appropriate valving whereby the operator can selectively direct pressurized fluid to and from the outlets. Although the outlets are shown as conventional rearwardly disposed outlets, the outlets herein could be located elsewhere in the tractor hydraulic system.

Attached to and depending from the body portion 20 of the tractor frame 14 is a front support member 32, the support member being upright and U-shaped and lying in a transverse upright plane immediately behind the front wheels 26. The support member includes a pair of vertical arms 34 and 36 that are respectively attached to the opposite side members 22 by bolt and nut type fasteners 38, a horizontal or bight member 40 extending between the lower ends of the vertical arms 34 and 36. A fore and aft circular socket or opening 42 is provided in the horizontal member 40 as best shown in FIG. 4. As is apparent, the member 32 can be attached at different vertical positions relative to the tractor side members 22 to adjust the mounting for different tractors.

A pair of latch elements 44, in the shape of rearwardly open V-shape members are respectively attached to the axle housing 16 by L-shaped brackets 46. The latch elements 44 are welded to the vertical portions of the brackets while the horizontal portions of the brackets 46 seat against the underside of the axle housing 16 and are fastened thereto by a plurality of bolts 48 that extend upwardly through appropriate holes in the bracket along opposite sides of the axle housing and through a top plate 50 that engage the top of the axle housing, appropriate nuts 51 being provided on the upper ends of the bolt to clamp the bracket 46 and consequently the latch element 44 to the axle housing. The latch elements are transversely spaced and are disposed adjacent the opposite ends of the axle housing 16 adjacent the interior side of the rear wheels 24. Each latch element 44 is V-shaped and includes rearwardly diverging vertically spaced arms having vertical holes 54 adapted to accommodate a locking pin.

The backhoe 10 includes a main frame indicated generally by the numeral 56, the main frame including a central portion 58 that supports a laterally swingable boom structure 60. The boom structure is of more or less well known conventional construction and includes a front support element 62 that is pivotally connected to the frame on a vertical pivot, a boom arm 64 pivotally connected to the support element on a transverse pivot, a dip stick 66 that is pivotally connected to the upper or rearward end of the boom arm 64, and a bucket 68 connected to the rearward end of the dip stick 66, the position of the boom arm, dipstick and bucket being controlled by hydraulic cylinders 70 in the well known manner. Similarly, the lateral position of the boom structure 60 is controlled by a swing cylinder (not shown). A pair of outrigger or stabilizer arms 72 extend laterally from the backhoe frame and are vertically adjustable relative thereto by means of independently actuatable control cylinders 74, the extension of the cylinders 74 causing the outer ends of the stabilizer arms 72 to swing downwardly and engage the ground and thereby raise the backhoe frame.

A backhoe operator seat 76 is provided on the central portion of the frame 58 and a plurality of valve control handles 78 are disposed adjacent the seat 76, the valve handle being connected to a back of control valves (not shown) that control the flow of pressurized fluid to and from the cylinders 70 and 74 in the well known manner, the bank of valves being provided with a pair of hoses 80 connected to a pressure inlet and a return outlet for the bank of valves. The hoses 80 are provided with conventional hose couplings 82 that can be releasably connected to the hydraulic outlets 30 on the tractor, whereby the tractor hydraulic system is used to power the backhoe, the above arrangement being of well known construction.

The backhoe frame 56 includes a fore and aft elongated forward portion 84 that extends forwardly from the central portion 58 of the frame. The forward portion 84 includes a pair of laterally spaced forwardly tapered side members 86 having their forward ends connected by transverse member 88. A cylindrical probe 90 is attached to and extends forwardly from the center of the front member 88. The probe 90 is provided with a conical tip 92 and has substantially the same diameter as the circular socket or opening 42 in the front support member 32 attached to the tractor, the probe and socket functioning as guide elements as the backhoe frame is mounted on the tractor frame. Preferably the probe is adjustably mounted in the member 88 to vary the length of the probe, so that the mounting can be adjusted to fit different sizes and makes of tractors.

A pair of cylindrical pins or latch elements 94 extend outwardly from the opposite side members 86 substantially to the rear of the forward ends of the side members 86. The pins are preferrably welded to the side members 86 and are coaxially aligned, the distance between the pins being the same as the distance between the latch elements 44 on the axle housing. The diameter of the pins 94 is substantially smaller than the opening in the V-shaped latch elements 44 and the pins 94 are seatable in the rearward ends of the latch elements as best shown in FIG. 2. A tapered or wedge type locking pin 96 is insertable downwardly through the holes 54 in the latch elements 44, the distance between the locking pin 96 and the forward end of the latch element 44 being substantially the same as the diameter of the pins 94 so that when the pins are seated against the forward end of the latching element, the locking pins 96 engage the rearward side of the pins 94.

Figure 5:
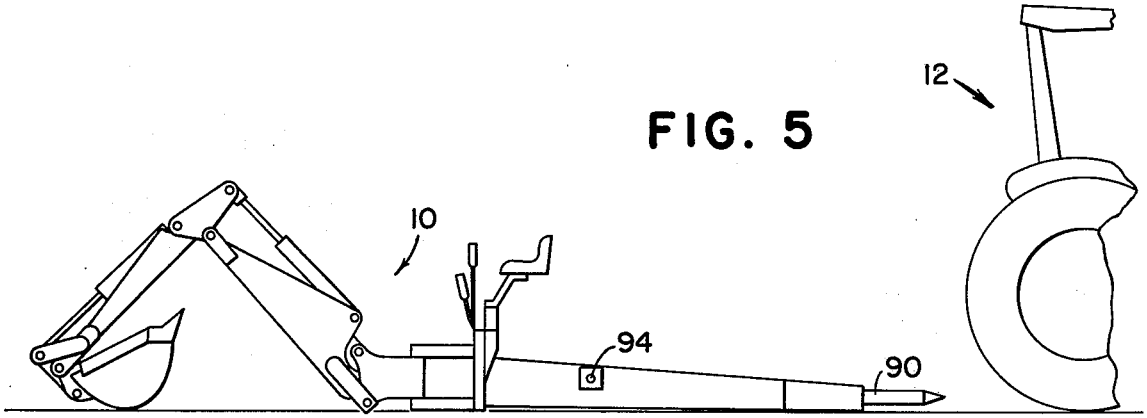
FIG. 5 is a side elevation view of the backhoe separated from the tractor.
Figure 6:
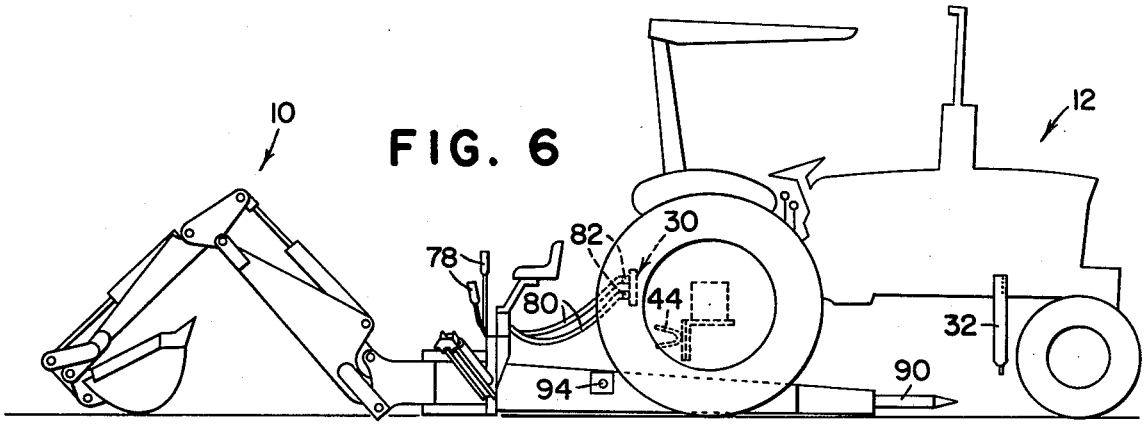
FIG. 6 is a side elevation view of the backhoe still resting on the ground at the time of the first step of the connection to the tractor.
Figure 7:
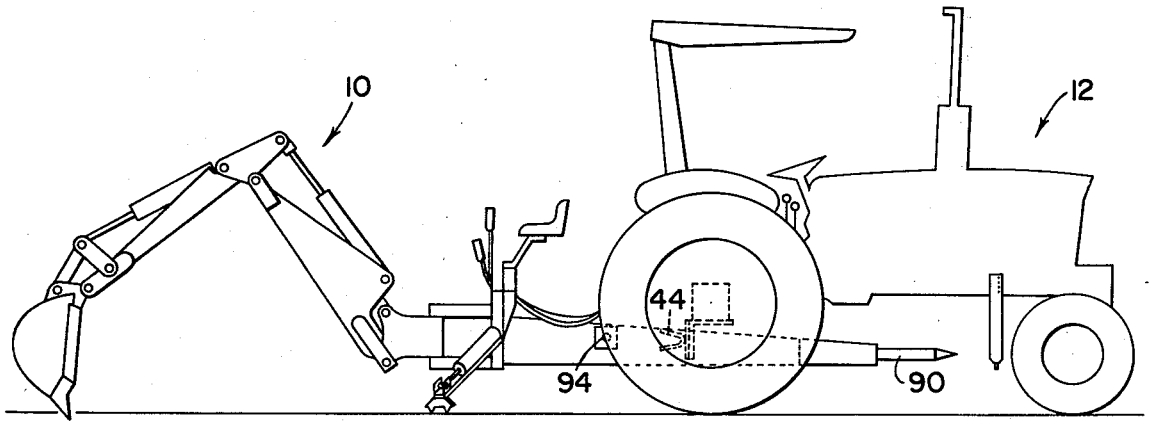
FIG. 7 is a side elevation view of the backhoe with its frame raised from the ground and positioned for connection to the tractor prior to the backing of the tractor into engagement with the backhoe.

In operation, when the tractor 12 is being used in normal farming operations, the backhoe 10 is stored on the ground as shown in FIG. 5. To mount the backhoe on the tractor, the operator backs the tractor up to the backhoe as shown in FIG. 5, with the fore and aft forward portion 84 of the backhoe frame in general fore and aft alignment with the body portion 20 of the tractor. The operator then backs the tractor 12 further with the rear wheels straddling the fore and aft forward portion 84 of the backhoe frame to the position shown in FIG. 6. The operator then dismounts from the tractor and plugs the hose couplings 82 into the tractor hydraulic outlets 30, the appropriate valve being opened on the tractor. Then, by manipulating the backhoe control valve handles 81, the hydraulic cylinders 70 and the outrigger cylinders 74 are actuated to raise the backhoe frame from the ground to the position shown in FIG. 7, the two outriggers or stabilizer 72 plus the boom structure 60 providing a three-point stance for the entire backhoe. Normally the outriggers are actuated so that the pins 94 are at the general level as the latch elements 44, and the boom structure or bucket 68 is then adjusted to control the attitude or angle of the backhoe frame so that the probe 90 is in general fore and aft alignment with the socket 42. When the proper alignment is obtained, as shown in FIG. 7, the tractor is then backed further, the pointed tip of the probe 90 entering the socket 42. The pointed tip 92 on the probe 90 allows for a degree of misalignment of the probe with the socket and as the probe 90 fully enters the socket, the backhoe frame is shifted into proper alignment.

When the probe 90 enters the socket, the pins 94 enter the opening in the latch elements 44. Again, the enlarged opening of the V-shaped elements 44 permit a degree of misalignment in the height of the backhoe frame relative to the tractor, the engagement of the pins 94 with the sloping top or bottom of the latch element 44 forcing the backhoe into the proper position as the tractor moves rearwardly relative to the backhoe frame. When the pins 94 reach the forward ends of the latch elements 44, as shown in FIG. 2, the operator stops the tractor and drops the wedge type locking pins 96 through the openings 54 in the latch elements to lock the pins in the latch elements 44. An additional lock pin can be inserted through the hole in the bottom of the wedge type locking pins 96 to insure that the locking pins 96 do not bounce out of the holes. The backhoe is then ready for operation on the tractor.

To remove the backhoe from the tractor, the reverse procedure is followed. Specifically, the operator first manipulates the control valves so that the stabilizers and the bracket firmly engage the ground. He then pulls the locking pins 96 and drives the tractor forwardly until the pins 94 clear the latch elements 44 and the probe 90 clears the socket 42. The operator then leaves the tractor, and by manipulating the backhoe control valves, allows the backhoe to settle to the ground to the position shown in FIG. 6, at which time the hydraulic couplings 82 are disconnected. The operator then is free to drive the tractor away from the backhoe.

One feature of the mounting is that it reduces the forces transmitted to the tractor frame. Specifically, the probe 90 is freely rotatable in the socket 42 so that no torque is transmitted from the implement, through the probe to the support member 32 and consequently to the tractor. Also, the pins 94 are free to rotate about their axes in the latch members 44, so that no torque is transmitted through the pins 94 to the latch elements and consequently to the brackets 46 and the tractor frame.

As is apparent, the probe and socket connection at the front of the tractor and the pin and receptacle type connection at the axle housings could be reversed, while still providing the limited force transmitting feature. Also, the pins 96 and the probe 90 could be provided on the tractor and the latch elements 44 and the socket 42 on the implement, rather than as illustrated.

We claim:

1. In a tractor having a main frame, including a fore and aft body portion having a pair of fore and aft laterally spaced side frame members and a transverse rear axle housing, a source of fluid pressure having an associated reservoir, and a pair of hydraulic outlets respectively connectible to the fluid pressure source and the reservoir, the combination therewith of improved means for mounting a material handling unit on the tractor wherein said unit includes a frame, a plurality of shiftable members, hydraulic motor means for shifting said members and control valve means for controlling the flow of fluid to and from said motors, said improved mounting means comprising:

an upright, transverse U-shaped forward support member having its opposite ends connected to the opposite side frame members of the tractor main frame and including a first guide element disposed generally below and centrally of the body portion:

a pair of first latch elements respectively connected to the axle housing adjacent the opposite sides of the tractor;

a second guide element attached to the forward end of the unit frame and engageable with the first guide element;

a pair of second latch elements attached to opposite sides of the unit frame rearwardly of the second guide element and respectively engageable with the first latch elements when the first and second guide elements are engaged and the unit is disposed in a predetermined position relative to the tractor, the tractor being moveable rearwardly relative to the material handling unit when the unit is separated from the tractor so the second guide element passes under the axle housing and engages the first guide element;

means for locking the latch elements in their engaged position;

and releasable connecting means for connecting the control valve means to the tractor outlets.

2. The invention defined in claim 1 wherein the first guide element comprises a socket and the second guide element comprises a probe member extending forwardly from the unit frame and insertable in the socket as the tractor moves rearwardly relative to the unit.

3. The invention defined in claim 2 wherein the probe has an elongated shank portion substantially conforming to and seatable in the socket and a forwardly converging tapered portion loosely insertable in the socket to accommodate a degree of initial misalignment of the probe and the socket.

4. The invention defined in claim 1 wherein the unit frame includes an elongated fore and aft portion extending beneath the axle housing and the body portion of the tractor frame when the unit is mounted on the tractor, the second guide element extending forwardly from said fore and aft portion.

5. The invention defined in claim 4 wherein the second latch elements comprise a pair of transversely aligned pins extending laterally from opposite sides of the fore and aft portion of the unit frame and each first latch element on the axle housing comprises a pair of vertically spaced rearwardly diverging members with vertical openings and means connecting said members to the axle housing, the latch elements being laterally spaced and adapted to receive the respective pins, and the locking means comprises a pair of vertical locking pins insertable downwardly through the openings in said diverging members behind the transverse pins when the latching elements are engaged to lock said transverse pins in the gap between said diverging members.

6. The invention defined in claim 5 wherein the first guide element comprises a socket and the second guide element comprises a probe member extending forwardly from the unit frame and insertable in the socket as the tractor moves rearwardly relative to the unit.

7. The method of attaching a backhoe to a tractor having a main frame with a generally fore and aft body portion and a rearward transverse axle housing, the tractor having a source of fluid pressure and an associated reservoir connectible to a pair of hydraulic outlets on the tractor, the backhoe having a main frame, a pair of laterally extending vertically adjustable stabilizers controlled by a pair of hydraulic cylinder means and a rearwardly extending vertically adjustable articulating boom having a bucket at its rearward end and controlled by hydraulic cylinder means, and control valve means having a pair of hydraulic lines connectible to the tractor outlets and further connected to the hydraulic cylinder means for controlling said cylinder means, said method comprising:

providing an elongated forwardly extending frame portion on the backhoe main frame with a guide element at its forward end and a pair of latch elements mounted on opposite sides of said frame portion rearwardly of the guide element; providing a guide element that is connected to and disposed below the body portion of the tractor and a pair of latch elements that are respectively connected to the axle housing adjacent the opposite sides of the tractor, the guide element and latch elements on the backhoe having the same relationship with one another as the guide element and latch elements on the tractor;

positioning the backhoe so that the forwardly extending frame portion is resting on the ground;

positioning the tractor forwardly of the backhoe when the backhoe is supported on the ground with the fore and aft portion of the backhoe frame in general fore and aft alignment with the body portion of the tractor; backing the tractor with the rear tractor wheels straddling the fore and aft portion of the backhoe frame until the hydraulic lines from the backhoe are capable of reaching the hydraulic outlets on the tractor; connecting the hydraulic lines to the tractor outlets; manipulating the control valves to actuate the hydraulic cylinder means controlling the vertical position of the boom and stabilizers so that the backhoe frame raises from the ground, the position of the stabilizers determining the height of the frame and the position of the boom controlling the attitude of the backhoe frame, so that the guide element on the backhoe frame is in fore and aft alignment with the guide element on the tractor and the latch elements on the backhoe frame are also in fore and aft alignment with the latch elements on the tractor frame; further backing the tractor until the tractor guide element engages the backhoe frame guide element and the tractor latch elements engage the respective latch elements on the backhoe frame; and locking the respective tractor latch elements to the backhoe fram latch elements.

8. The invention defined in claim 7 wherein the tractor guide element is provided in the form of a central fore and aft socket and the backhoe guide element is provided in the form of a probe having a shank portion conformable with and insertable into the socket and a tapered forward end, the forward end of the probe moving into the socket initially to accommodate a small degree of misalignment of the probe with the socket, the rearward movement of the socket along the tapered forward portion of the probe as the tractor moves rearwardly relative to the backhoe correcting said misalignment of the probe in the socket.

9. The invention defined in claim 8 wherein each latch element on the tractor includes a pair of vertically spaced rearwardly diverging members, the rearward opening being substantially greater than the vertical dimension of the latch element on the backhoe frame to accommodate a degree of vertical misalignment of said latch elements, the convergance of said members causing a small degree of vertical adjustment of the backhoe frame as the tractor moves rearwardly relative to the backhoe frame to the full engagement position of said latching elements.

10. In a tractor having a main frame including a fore and aft body portion and a transverse rear axle housing, the combination therewith of improved means for mounting an implement having a frame on the tractor, said improved mounting means comprising:

a forward support member connected to the body portion of the tractor main frame and including a first connecting element generally below and centrally of said body portion;

a pair of first laterally spaced latch elements respectively connected to the axle housing on opposite sides of the body portion;

a second connecting element attached to the forward end of the implement frame and rotatably engageable with the first connecting element about a fore and aft axis;

a pair of laterally spaced second latch elements attached to the implement frame rearwardly of the second connecting element and rotatably engageable with the first latch elements about a transverse axis when the first and second connecting elements are engaged, the first connecting element bearing generally the same spatial relationship to the first latch elements as the second connecting elements bears to the second latch elements;

and means for releasably locking at least one of the first elements in rotatable engagement with the associated second element.

11. The invention defined in claim 10 wherein the second latch elements comprise a pair of transverse pins extending laterally from opposite sides of the implement frame and each of said first latch elements include a pair of rearwardly open, vertically spaced members adapted to rotatably receive one of said pins between the members.

12. The invention defined in claim 11 wherein the locking means comprises a pair of vertical locking pins respectively insertable through the vertically spaced members of each first latch element rearwardly of the pins to lock the pins in the respective first latch elements.

* * * * *